United States Patent [19]

Mizuma

[11] 3,979,186

[45] Sept. 7, 1976

[54] STEEL ROD FOR PRESTRESSING CONCRETE

[75] Inventor: Katsuhisa Mizuma, Fujisawa, Japan

[73] Assignee: Neturen Company Ltd., Tokyo, Japan

[22] Filed: Mar. 17, 1975

[21] Appl. No.: 559,302

[30] Foreign Application Priority Data

Oct. 25, 1974 Japan ..... 49-122427
Oct. 25, 1974 Japan ..... 49-122428

[52] U.S. Cl. ..... 29/183.5; 29/193; 52/737; 148/12 B

[51] Int. Cl.[2] ..... B21C 37/04

[58] Field of Search ..... 29/183.5, 193; 148/12 B; 92/736, 737, 738, 739

[56] References Cited

UNITED STATES PATENTS

| | | | |
|---|---|---|---|
| 411,202 | 9/1889 | Rose | 52/736 X |
| 1,399,701 | 12/1921 | Dyson | 52/736 |
| 2,816,052 | 12/1957 | Hoff et al. | 148/12 B |
| 3,561,185 | 2/1971 | Finsterwalder et al. | 52/737 |

OTHER PUBLICATIONS

"Concrete", June 1947.

"Univ. of Ill. Eng. Expt. Sto. Bulletins," Abrams, 193, pp. 61, 72, 73.

*Primary Examiner*—Arthur J. Steiner

*Attorney, Agent, or Firm*—Wenderoth, Lind & Ponack

[57] ABSTRACT

A steel rod for prestressing concrete which is enclosed in concrete to introduce prestress in said concrete (hereinafter called a P. C. steel rod). The P. C. steel rod has a circular section around which a plurality of spiral grooves have been formed by means of a die. One or more flat surfaces can be formed in the axial direction or the rod for greater adhesion to the concrete. The P. C. steel rod has a far shorter bond length than a conventional P. C. Steel rod and therefore it has greater adhesion to the concrete and when tensioned, the concrete does not develop longitudinal cracks, thus assuring reliable introduction of prestress in the concrete.

7 Claims, 19 Drawing Figures

STEEL ROD FOR PRESTRESSING CONCRETE

The present invention relates to a steel rod for prestressing concrete hereinafter called a P. C. steel rod, having a circular cross-section and having a plurality of spiral grooves formed thereon by a die.

BACKGROUND OF THE INVENTION:

Conventionally two types of P. C. steel rods are known, as illustrated in FIGS. 2*a*, 2*b*, 3*a* and 3*b*, a so-called indented rod which is a steel rod 13 in which round concave depressions 14 are formed at specified intervals in the longitudinal direction thereof, and a so-called P. C. strand 15 which is made up of a plurality of more than two steel wires 16 twisted together.

As will be explained hereinafter, the indented rod has the drawbacks that differences in their lengths after they are drawn out, and the depressions are not very effective in increasing the adhesion to the concrete. As for the P. C. strand, as will also be explained hereinafter, it is hard to achieve the prescribed tension load, using this type of bar.

OBJECTS AND BRIEF SUMMARY OF THE INVENTION:

In view of these disadvantages of the conventional P. C. steel rods, the first object of the present invention is to provide a P. C. steel rod having a bond length far shorter than a conventional P. C. steel rod and accordingly greater adhesion to the concrete, with which there is no likelihood of a crack being developed in the concrete when the rod is tensioned, and by means of which a precise desired prestress can be given to the concrete.

The second object of the present invention is to provide a P. C. steel rod in which the cross-sectional area is uniform over the entire length, so that several rods can be easily tensioned at the same time and with which there is absolutely no need of pretensioning.

The third object of the present invention is to provide a P. C. steel rod in which the fixed end can be easily and reliably formed and accordingly exact introduction of stress in the concrete is assured.

SUMMARY OF THE INVENTION:

These objects are achieved by a steel rod for prestressing concrete having a circular cross-section and a plurality of spiral grooves there around. On the periphery of the steel rod there can be a plurality of flat surfaces extending axially of the rod for increasing the adhesion between the rod and the concrete, assuring better performance of the rod as a large-diameter P. C. steel rod. It is preferable that the total width of voids left by said plurality of spiral grooves in a cross-section be in the range of one-sixth–two-fifths of the total circumference; the width of a single spiral groove be less than one-tenth of the outer diameter of the rod; and the width of said flat surfaces be equal to 26.5 – 27% of the outside diameter of the rod. For the purpose of forming such spiral grooves around the rod, it is desirable to use a drawing die and the formation of spiral grooves around the rod by use of the drawing die is preferably followed by heat treatment which increases the strength of the P. C. steel.

BRIEF DESCRIPTION OF THE DRAWINGS:

The foregoing objects and other objects as well as characteristic features of the invention will become more apparent and more readily understandable by the following description and the appended claims when read in conjunction with the accompanying drawings, in which:

FIG. 1(*b*) is a longitudinal section view of a prestressed concrete pile manufactured according to the arrangement shown in FIG. 1(*a*);

FIG. 2(*b*) is a section taken on line 2*b*—2*b* of FIG. 2(*a*);

FIG. 3(*b*) is a section taken on line 3*b*—*3b* of FIG. 3(*a*);

FIG. 4(*b*) is a section taken along line 4*b*—4*b* in FIG. 4(*a*);

FIG. 4(*c*) is an elevation of another embodiment of the P. C. steel rod of the present invention;

FIG. 4(*d*) is a section taken on line 4*d*—4*d* of FIG. 4(*c*);

FIG. 5(*b*) is a section taken on line 5*b*—5*b* of FIG. 5(*a*);

FIG. 6(*b*) is an elevation of a head portion formed at one end of a P. C. steel rod according to the present invention;

FIG. 8(*b*) is a side view of the set up of FIG. 8(*a*);

FIG. 8(*c*) is a diagram showing the results of experiments carried out with the set up of FIG. 8(*a*) and 8(*b*)

Figure 1A:
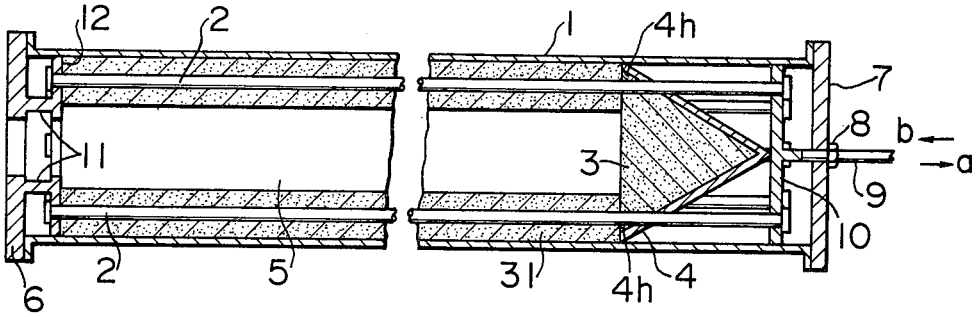
FIG. 1(a) PRIOR ART
FIG. 1(*a*) is a longitudinal section view for explaining generally how a P. C. steel rod is used.
Figure 1B:
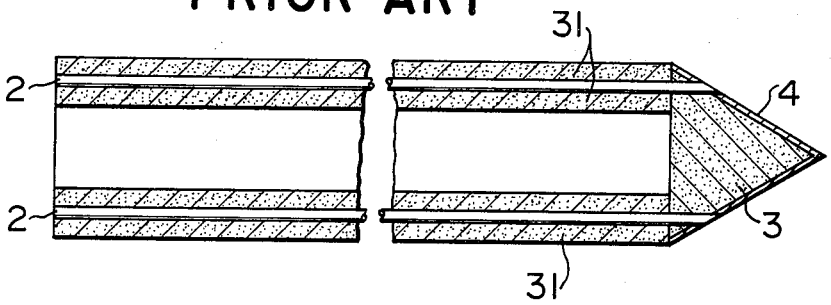
FIG. 1(b) PRIOR ART

DESCRIPTION OF THE PREFERRED EMBODIMENT:

First for better understanding of the present invention, the general manner of using a P. C. steel rod will be described in connection with a prestressed concrete pile. In FIG. 1(*a*) plurality of P. C. steel rods 2 are arranged at specified intervals around a space corresponding to the peripheral wall of the pile. One end of each P. C. steel rod 2 is fixed at a specified position around the joint 12 of hollow circular form. The joint 12 is connected by connector 11 to a terminal plate 6. The other end of the P. C. steel rod 2 is fixed to a tensioning jig 10. The tip of a conical shoe 4 filled with concrete 3 is fixed to the center of the tensioning jig 10 on the inside thereof and the portions of the P. C. steel rods 2 near the other ends extend through holes 4 at specified position in the shoe 4.

A tensioning rod 9 has one end fixed to the center of the tensioning jig 10 on the outside thereof and is pulled pulled in the direction of arrow *a* by means of a hydraulic jack and then anchored to a terminal plate 7 by a nut 8. The P. C. steel rods can thus be maintained in a constant state of tension.

Such an assembly is positioned within the concrete mold 1. The terminal plates 6 and 7 constitute end faces and the mold 1 constituting the peripheral portion are held together as a solid unit and several P. C. steel rods 2 maintained in a constant state of tension are positioned within the mold. Then, concrete is poured through the hollow part of the terminal plate 6 and solidified by centrifugal compaction thereby leaving a hollow center 5. After the concrete 31 has set, the nut 8 is turned in the appropriate direction to relax the tension of the P. C. steel rods. As a consequence, the P. C. steel rods 2 tend to move in the direction of arrow *b*. If moderate adhesion is present between the periphery of the P. C. steel rods 2 and the concrete 31, the concrete which is stuck to said tension rods 2 will move in the direction of arrow *b* together with the movement of the P. C. steel rods as they relax and as a result the concrete will be placed under a compressive force. Thus the object of using the P. C. steel rods to strengthen the concrete 31 by placing it under compression can be attained. After a specified compressive force has been given to the concrete 31, the mold 1 and the terminal plates 6 and 7 are removed and the portion of each P. C. steel rod projecting out of the shoe 4 is cut off, producing a P. C. pile as shown in FIG. 1(*b*).

Conventional P. C. steel rods having adhesion promoting configurations do not work well in the process just described.

Figure 2A:
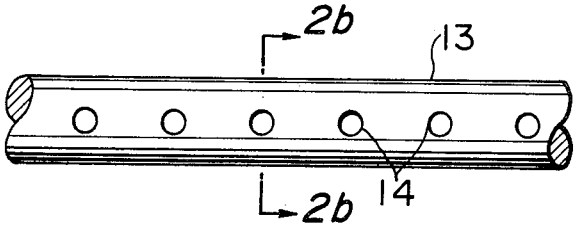
FIG. 2(a) PRIOR ART
FIG. 2(*a*) is an elevation of a conventional P. C. steel rod.
Figure 2B:
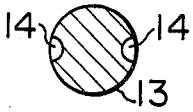
FIG. 2(b) PRIOR ART

FIGS. 2(*a*) and 2(*b*) illustrate a so-called indented rod which is a round steel rod 13 in which round depressions 14 are formed at specified intervals along the length thereof.

The cross-sectional area of this steel rod is not uniform over the entire length thereof, being less where there are depressions than where there are none. Thus, when several of them are to be tensioned at the same time, the lengths after they are tensioned are likely to be different and simultaneous tensioning of them is impossible. Meanwhile, the thread at the fixed end which is used for tensioning cannot be provided before the end is prepared for threading. Moreover, an increased adhesion to the concrete at the depressions 14 cannot be achieved at the time of introducing compressive stress in the concrete, because the concrete which fills the depressions 14 is liable to break off from the main body of concrete easily. Moreover, since the stress introduction is designed on the basis of a cross-sectional area with the depressions subtracted therefrom, this is poor economy in the use of the metal of the rods.

Figure 3A:
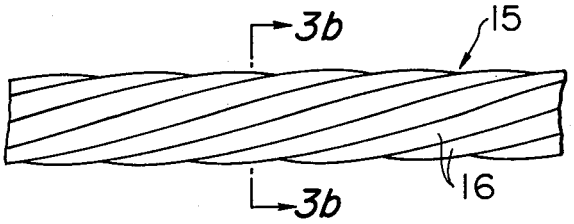
FIG. 3(a) PRIOR ART
FIG. 3(*a*) is an elevation of another conventional P. C. steel rod.
Figure 3B:
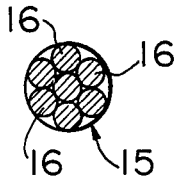
FIG. 3(b) PRIOR ART
Figure 4A:
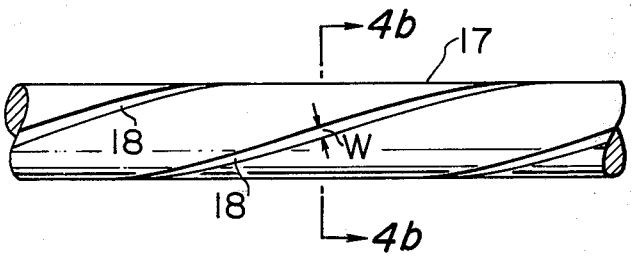
FIG. 4(*a*) is an elevation of one embodiment of the P. C. steel rod of the present invention.
Figure 4B:
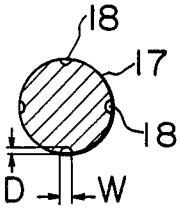
Figure 4C:
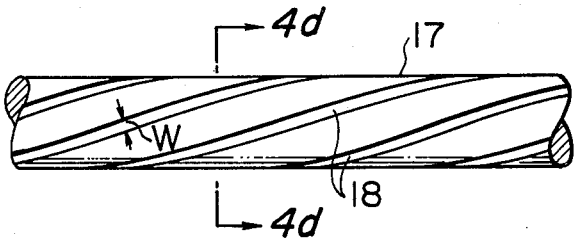
Figure 4D:
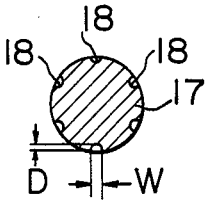

The rod illustrated in FIGS. 3(*a*) and 3(*b*) is a so-called P. C. strand 15, which comprises more than two steel wires 16 twisted together. This P. C. strand, in which excess elongation unavoidably occurs, has to be pretensioned. At the time of tensioning, the fixed end has to be fixed by chucks, but slipping unavoidably occurs within the chucks, making it impossible to apply an exact specified tension load to the steel strand.

The present invention has been made to eliminate the above-mentioned drawbacks in the conventional P. C. steel rods.

FIGS. 4(*a*) and 4(*b*) illustrate a basic example of the P. C. steel rod of the present invention. A steel rod 17 having a circular cross-section has a plurality of spiral grooves 18 therearound. The number of spiral grooves and the pitch are appropriately chosen to suit the practical application of the rods of the present invention. It is preferable that the pitch of the grooves and the width and depth of each groove be constant so that the cross-sectional area of the rod will be uniform throughout the entire length.

Figure 7:
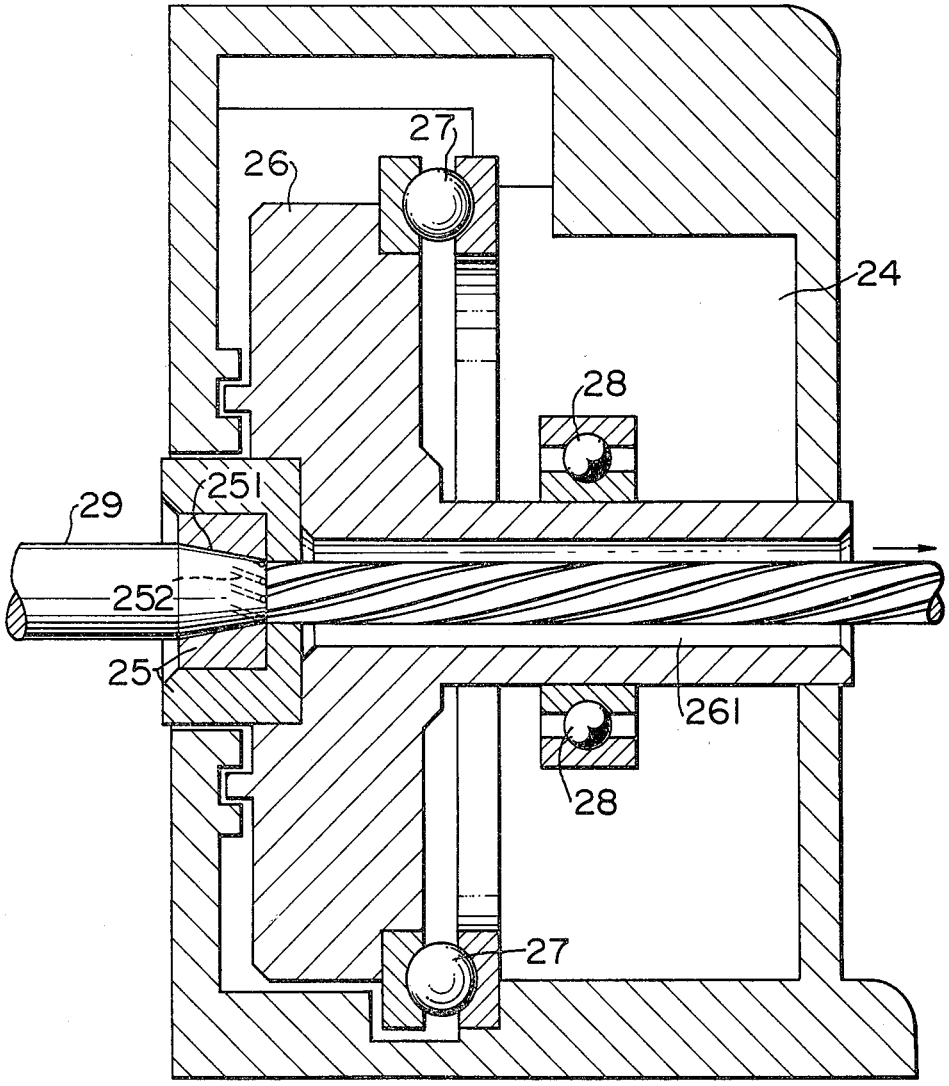
FIG. 7 is a section of one example of a drawing die which can be used in the manufacture of a P. C. steel rod according to the present invention.

According to the present invention, a drawing die as illustrated in FIG. 7 is used to form the spiral grooves 18 around the steel rod 17.

As shown in FIG. 7, a body of a drawing device 24 has a drawing die 25 mounted therein having a hole 251 therethrough with the diameter thereof decreasing gradually from the left to the right end in FIG. 7. On the internal wall of said hole 251 are spiral projections 252. The diameter at the left end of said hole 251 in the drawing die 25 is fixed to the left end (in the figure) of a spinning body 26 which has a hole 261 therethrough the diameter of which is larger than that of said hole 251 communicate with each other, the right end of hole 251 opposing the left end of hole 261. Said spinning body 26 is rotatably mounted on said body 24 on a thrust bearing 27 and a bearing 28. With such an arrangement when the blank 29 is drawn out in the direction of the arrow after being pressed into the left end of the drawing die 25, the frictional force created during this drawing causes the spinning body 26 and the drawing die 25 to turn in a specified direction. In this process of drawing the blank 29 is worked at a rate width determined by the tapering of the diameter of said hole 251, while at the same time spiral grooves matching the spiral projections 252 on the inside wall of the drawing die 25 are formed around the blank 29. This process of drawing the blank yields a steel rod as illustrated in FIGS. 4(*a*) – 4(*d*) which has a far greater strength then the blank itself, a strength which is unobtainable when grooves are formed by machining. The rod has an outer diameter which is uniform over the entire length of the rod and a smooth surface. FIGS. 4(*a*) and 4(*b*) illustrate a rod having four spiral grooves provided at equal pitch, and FIGS. 4(*c*) and 4(*d*) illustrates a rod with six spiral grooves provided at equal pitch. When it is necessary to increase the strength of the steel rod thus produced, said steel bar rod only to be heat-treated by a conventional method such as high frequency induction heating or flame treatment.

As a result of testing the P. C. steel rod thus produced in various tests, it has been discovered that for the purpose of giving desirable stress to the concrete in a reliable manner due to adhesion to the concrete, it is most advisable to design said spiral grooves as follows:

1. The sum of the widths W of voids created by the plurality of spiral grooves in a cross-section should be in the range of one-sixth – two-fifths of the total circumference of the rod.

In a simple "concrete-reinforcing steel rod" which is sealed in the concrete but is not intended for introducing stress in the concrete, the process of tensioning and relaxing is not a consideration. If the rod is sealed to the concrete as if it were the core of the concrete, the purpose of the rod is attained. Thus for a "concrete reinforcing steel rod", any arrangement which maximizes the adhesion to the concrete suffices. In the case of a P. C. steel rod, however, the purpose is to strengthen the concrete by compression of the concrete utilizing the adhesion of steel to the concrete when the tensioned rod is relaxed. For the purpose of tensioning the steel rod, one end is fixed and has to be firmly secured because otherwise it would be impossible to give a predetermined stress to the concrete.

Figure 6A:
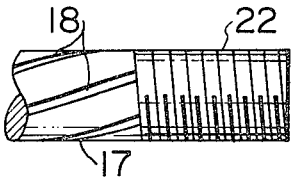
FIG. 6(*a*) is an elevation of a threaded portion formed at one end of a P. C. steel rod according to the present invention.
Figure 6B:
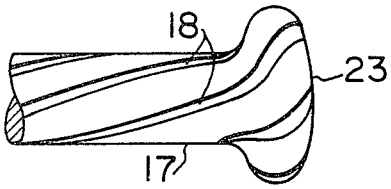

The fixing of the one end can be achieved by either of the following two methods. In the first method, as illustrated in FIG. 6(*a*), a thread 22 is formed around the end to be fixed, and using a nut with a screw engaging said thread, the end is fixed to a terminal plate. In the second method, as illustrated in FIG. 6(*b*), a head 23 is forged at the end to be fixed and using said head 23, the end is fixed.

If in the present invention the former method is adopted, said thread 22 will be formed at the end where spiral grooves are provided. Therefore when in the cross-sectional area of rod the sum of the widths of voids created by said spiral grooves becomes large as compared with the total circumference of the rod, shear failure may occur at the nut.

According to the results of experiments conducted with the present invention, when a steel rod having an outer diameter 9.2mm and, as illustrated in FIG. 4(*a*) and 4(*b*), has four spiral grooves symmetrically spaced therearound, and the sum of the widths W of said voids exceeds one-half of the total circumference, shear failure is likely to occur at the nut. It is also known that when the safety factor allowing for screw-fitting error is considered, said sum of the void widths should be less than two-fifths of the total circumference. Subsequent experimental data shows that it is most desirable that the sum of the void widths be about one-third of the total circumference. Further it has been found that, when considering adhesion to the concrete, the object of the present invention will be attained if said sum of the void widths W is in the range of one-sixth – two-fifths of the total circumference.

2. The width W of a single spiral groove should be in the range of one twenty-fourth – two-fifteenths of the total circumference.

In the P. C. steel rod of the present invention it is desirable that the width of each spiral groove be identical.

According to the results of experiments using a steel rod with the same outer diameter (9.2mm) and the same number of spiral grooves, four, formed therein, when the width of a single spiral groove is less than 1mm, the concrete filling the groove is broken away from the main body of concrete when the tension is relaxed and an increased adhesion to the concrete cannot be achieved. When the width of a single spiral groove is larger than two-fifteenths of the total circumference, the threads on the threaded end of the rod are too short, resulting in a decreased strength of the threaded part and occasionally making it impossible to introduce the desired stress into the concrete. It has been found that when the width of a single spiral groove is in the range of 1.8mm – 2.5mm, the end can be securely fixed by a threaded nut and a desirable adhesion to the concrete is assured, thereby making it possible to give the desired stress to the concrete.

According to the results of another experiment conducted with the present invention, when the width of a single spiral groove is in the range of one twenty-fourth – two-fifteenths of the total circumference, the object of the present invention can be attained.

3. Under the above conditions, it is desirable that the central depth of spiral groove D be less than one-tenth of the outer diameter of the steel rod.

If the depth of the spiral groove is more than the above value, the bottom of the grooves will be below the bottom of the threads, resulting in a decreased strength of the threaded portion.

According to the results of experiments conducted with the present invention using a steel rod having an outer diameter of 9.2mm and four spiral grooves therein, and having the voids created by spiral grooves within the limits specified in (1) and (2) above, the most desirable depth of the groove is about 0.5mm.

It has been found that the above-mentioned results of the experiments agree with the results of experiments conducted with the present invention using steel rods according to the present invention having an outer diameter in the range of 7.8 – 14mm and 3 – 6 spiral grooves formed therein.

Thus, all of the above-mentioned conditions have to be satisfied for the purpose of achieving a desirable steel rod for prestressing concrete according to the present invention. Therefore, when all the spiral grooves are equally deep, the width of a single spiral groove is at the upper limit, the number of spiral groove being more than six and under the condition that the total void width exceeds the minimum value in the first requirement set forth above, then the number of spiral grooves or the width of a single spiral groove has only to be adjusted within the specified range. It has been found that from the standpoint of adhesion to the concrete and for the purpose of producing a steel rod without exerting unreasonable force on the drawing die, the most desirable pitch of the spiral grooves is about 10 times the outer diameter of the steel rod.

Figure 5A:
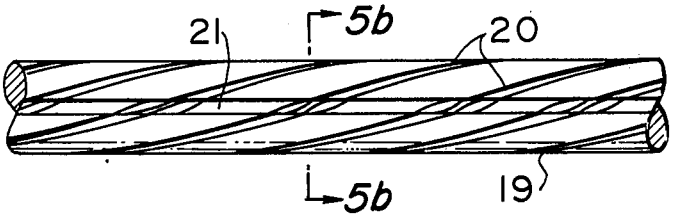
FIG. 5(*a*) is an elevation of a third embodiment of the P. C. steel rod of the present invention.
Figure 5B:
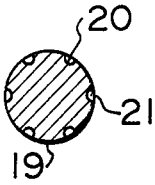

A third embodiment of the present invention is illustrated in FIGS. 5(*a*) and 5(*b*). In this embodiment, as compared with the first and second embodiments, a P. C. steel rod having increased adhesion to the concrete is provided. In the rod of FIGS. 5(*a*) and 5(*b*), spiral grooves 20 are formed around the steel rod 19 having a circular cross-section. Just as in the first and second embodiments, it is desirable that the spiral grooves 20 be formed by means of a drawing die. The number of spiral grooves is selected according to the use of the rod.

Flat surfaces 21 extending parallel to the axis are formed on the surface of the steel rod 19 having the spiral grooves therein. Said flat surfaces 21 can be formed by means of a conventional roller die. Depending on the need, a plurality of flat surfaces 21 can be formed.

The width of each flat surface 21, when two such flat surfaces are formed at diametrically opposite positions on the cross-section of the rod, as shown in FIG. 5(*a*) and 5(*b*), has only to be such that it makes the cross-section of the steel rod look rather oval. It is preferable that the width of the flat surface be greater the greater the diameter of the steel rod.

An experiment conducted with the present invention has shown that the preferred width of the flat surface is in the range of 26.5 – 27% of the outside diameter of the rod after the spiral grooves have been formed therein.

In the embodiment of FIGS. 5(*a*) and 5(*b*), the surface of the flat surface 21 is not as deep into the rod as the bottom of the spiral groove. However, the greater the width of the flat surface 21, the closer the surface of the flat surface 21 comes to the bottom of the spiral groove.

if it is necessary to increase the strength of the steel rod, additional heat treatment can be carried out just as in the first and second embodiments. As illustrated in connection with the first and second embodiments, the steel rod with the spiral grooves therearound, when the width and depth of the spiral grooves are as specified above, will make an excellent P. C. steel rod with good adhesion to the concrete. In this steel rod, however, with some grooves running in the same direction, as a result of the concrete and the rod being mutually twisted at the time of introduction of stress in the concrete, the stress introduced tends, particularly at the end of rod, to be relieved in the same way as between a nut and a screw.

In the third embodiment, due to the presence of the flat surfaces 21, the frictional resistance between the rod and the concrete is so great that no relief of the introduced stress is likely to occur, even at the end. The steel rod of the third embodiment, as compared with the first and second embodiments, has greater adhesion to the concrete and accordingly can have a shorter anchoring length.

To verify the merits of the present invention, various tests have been carried out, some examples of which will now be described.

EXAMPLE 1

The test in this example was carried out to verify the effectiveness of the first and second embodiments shown in FIGS. 4(*a*) – 4(*d*).

The following test rods were prepared:

A. A steel rod having an outside diameter of 11mm, a cross-sectional area of 1.2mm$^2$ and having 6 spiral grooves thereon, the total void width and central depth of the spiral grooves being within the above specified limits and the pitch of the grooves being 10 times the diameter of the bar.

B. A round P. C. steel rod having a circular cross-section with an outside diameter of 10.90mm.

Figure 8:
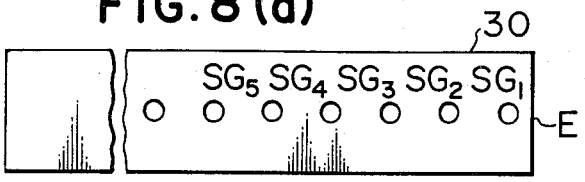
FIG. 8(*a*) is a front view illustrating the procedure followed in an experiment carried out using the steel rods of the present invention.
Figure 8:
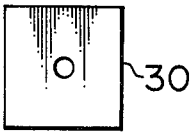
Figure 8:
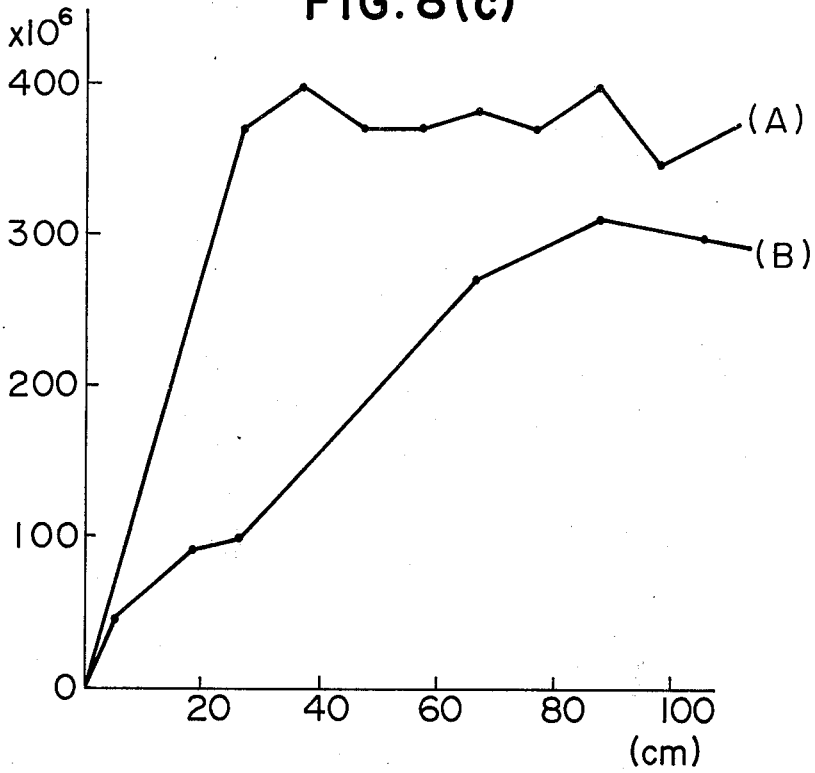
Figure 9:
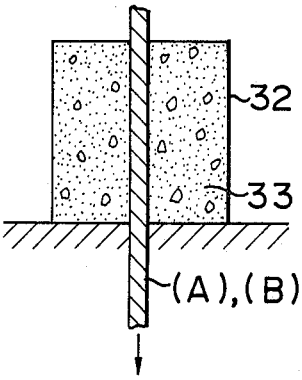
FIG. 9 is a section illustrating the procedure of another experiment carried out using the steel bar of the present invention.

Testing procedure and conditions:

Said test rods (A) and (B) were, as shown in FIGS. 8(*a*) and 8(*b*) placed along the center of a mold 30 1500mm long and having a cross-section 80mm × 80mm. The thread portion formed at one end of the samples (A) and (B) was fixed to the terminal plate using a nut which engaged that portion. Tension was then applied and measured by means of a tension tester. With the rod tensioned, concrete was poured into the mold and strain gauges $SG_1$, $SG_2$ . . . were positioned along the longitudinal surface of the concrete. Strain gauges $SG_1$ was positioned 5cm from the stress-introducing end E, $SG_2$ was placed 15cm therefrom, $SG_3$ was placed 25cm therefrom, etc., one gauge being located at every 10cm interval. One week after the concrete had been poured, when the strength of the concrete had reached about 400kg/cm$^2$, the tension on the rod was relaxed and the strain transmitted thereby to the concrete was read from said strain gauges.

Results:

The results were as shown in FIG. 8(*c*), in which the ordinate is the strain and the abscissa is the distance from the stress-introducing end, curve (A) being the result for the P.C. steel rod according to the present invention and curve (B) being the result for the conventional P. C. steel rod with the circular section.

As is apparent from FIG. 8(*c*), whereas the anchoring length of the P. C. steel rod according to the present invention was about 35 times the diameter, that of the conventional P. C. steel rod having the circular cross-section was about 100 times the diameter. This shows that adhesion to the concrete by the P. C. steel rod of the present invention is about three times as strong as that of the conventional P. C. steel rod with a circular cross-section.

From these results, it is concluded the present invention makes it possible to use in a practical way a large diameter P. C. steel rod which has so far failed to be adopted on account of inferior adhesion to the concrete.

EXAMPLE 2

The test in this example was carried out to compare the initial slip stress and the maximum bonding stress for the rods of the three embodiments.

The following test rods were prepared:

A. A round steel rod having a cross-section of 61.9mm$^2$ with 6 spiral grooves and 2 symmetrical flat surfaces formed thereon, the total void width of spiral grooves, the width of a single spiral groove and the central depth being in the specified ranges in the first and second embodiments, and the width of the flat surfaces being in the range of 26.5 – 27% of the outside diameter of the steel rod after the spiral grooves are formed therein.

B. A P. C. steel rod having the same cross-section as the rod (A), with 6 spiral grooves of the same dimensions as the grooves of rod (A) formed therein.

Test conditions:

A 15cm$^3$ mold was prepared and the above-described test rods (A) and (B) were placed in the center thereof. Then the concrete 33 was poured into said mold. When the concrete solidified to a strength of 300kg/cm$^2$, a drawing force in the direction of the arrow was applied to rods (A) and (B) by means of a known tension tester and thereby the initial slip stress, the stress at a point at which a displacement of 2/1000mm occurred, and the maximum bonding stress to the concrete were determined from the readings of relative slip on a dial gauge.

The initial slip stress for rod (A) was about 1.3 times as large as that for rod (B), and the maximum bonding stress for rod (A) was about 2.5 times as large as that for rod (B).

Thus, the rod of the third embodiment, which has greater adhesion to the concrete than rods of the first and second embodiments, is extremely good as a large-diameter P. C. steel rod.

As is evident from the above results:

1. The steel rods of the first and second embodiments of the present invention have a far superior adhesion to the concrete than does a conventional P. C. steel rod with a circular cross-section and are very useful as a large-diameter P. C. steel rod;

2. When used as a P. C. steel rod for a P. C. pile, in spite of a short anchoring length they are not likely to cause longitudinal cracking of concrete, because they have no convex depressions in the surface which tend to cleave the concrete;

3. Unlike the conventional steel rods illustrated in FIGS. 2 and 3, they have a cross-section which is uniform over the entire length, and accordingly even when several of them are tensioned at the same time, their elongations are identical. Thus, simultaneous tensioning can be carried out easily. Meanwhile, there is absolutely no need of pretensioning as is done with the known P. C. strand;

4. Since the P. C. steel rods are produced by drawing through a die, the end can be finished as it is, without tapping, to a rolled thread;

5. The steel rods of the various embodiments can be used even when a head is formed at one end, and utilizing said head to fix the rod, and thereby a desirable stress introduction can be effected. Since they can be made truly round, the head is not likely to be deformed when hammered, and because the bottom of the head is made irregular as seen in FIG. 6(*b*), in the stress-introducing process the P. C. steel rod bites into the anchor plate which can be made from a mild steel which is softer than the material of the P. C. steel rod and as a result can be prevented from being rotated;

6. In the steel rod of the third embodiment, to the various advantages and effects of the first and second embodiments is added the most important affect of increasing adhhesion to the concrete and in consequence reducing the anchoring length as compared with the first and second embodiments, and thus the most desirable large-diameter P. C. steel rod is provided.

What is claimed is:

1. A steel rod for prestressing concrete by pretensioning the rod and then casting the concrete therearound said rod, having a circular cross-section and having a plurality of spiral grooves therearound and at a uniform pitch of about 10 times the diameter of said rod, the total width of the voids of the spiral grooves being 1/6 – 2/5 of the total circumference of the rod, the width of each spiral groove being from 1/24 – 2/15 of the total circumference, and the depth of each spiral groove at the center thereof being less than 1/10 of the outside diameter of the rod.

2. A steel rod as claimed in claim 1 in which the total width of the voids is about one-third of the total circumference of the rod.

3. A steel rod as claimed in claim 1 in which the width of each groove is from 1.8mm to 2.5mm.

4. A steel rod as claimed in claim 1 in which the depth of each groove is about 0.5mm.

5. A steel rod as claimed in claim 1 in which the rod has been drawn for forming the grooves.

6. A steel rod as claimed in claim 1 further having a plurality of flat surfaces thereon parallel to the axis of the rod.

7. A steel rod as claimed in claim 6 in which the width of each flat surface is from 26.5 – 27% of the outside diameter of the rod.

* * * * *